US008959960B2

(12) United States Patent
Hill et al.

(10) Patent No.: US 8,959,960 B2
(45) Date of Patent: Feb. 24, 2015

(54) APPLIANCE DOOR PROP MECHANISM

(75) Inventors: Chris H. Hill, Ames, IA (US); Jason Schott, Webster City, IA (US); Douglas C. Norman, Webster City, IA (US); Tommy D. Brindle, Jr., Indian Trail, NC (US); Jerry Rosenberger, Ames, IA (US)

(73) Assignee: Electrolux Home Products, Inc., Charlotte, NC (US)

( * ) Notice: Subject to any disclaimer, the term of this patent is extended or adjusted under 35 U.S.C. 154(b) by 1074 days.

(21) Appl. No.: 12/849,657

(22) Filed: Aug. 3, 2010

(65) Prior Publication Data

US 2012/0032569 A1 Feb. 9, 2012

(51) Int. Cl.

| | |
|---|---|
| ***B08B 3/12*** | (2006.01) |
| ***D06F 37/00*** | (2006.01) |
| ***E05C 17/50*** | (2006.01) |
| ***D06F 39/12*** | (2006.01) |
| ***D06F 39/14*** | (2006.01) |
| *E05B 15/02* | (2006.01) |

(52) U.S. Cl.

CPC ..... *E05C 17/50* (2013.01); *D06F 39/12* (2013.01); *D06F 39/14* (2013.01); *E05B 2015/023* (2013.01)

USPC ..... 68/3 R

(58) Field of Classification Search

None

See application file for complete search history.

(56) References Cited

U.S. PATENT DOCUMENTS

| | | | | |
|---|---|---|---|---|
| 2,269,537 | A | 1/1942 | Krause | |
| 2,982,540 | A | 9/1959 | Eppley et al. | |
| 3,520,568 | A | 7/1970 | White et al. | |
| 4,474,492 | A | 10/1984 | Fleitas | |
| 4,971,373 | A | 11/1990 | Hamada et al. | |
| 5,628,148 | A | 5/1997 | Beutler | |
| 5,771,720 | A | 6/1998 | Levenson | |
| 7,154,058 | B2 | 12/2006 | Kim et al. | |
| 7,172,224 | B2 | 2/2007 | Carter | |
| 7,226,094 | B2 | 6/2007 | Swink | |
| 7,269,981 | B2 | 9/2007 | Kwon | |
| 7,377,500 | B2 | 5/2008 | Tomiji et al. | |
| 8,123,312 | B2 | 2/2012 | Jeon et al. | |
| 2009/0064725 | A1 * | 3/2009 | Lim et al. | 68/139 |
| 2009/0251032 | A1 * | 10/2009 | Jeon et al. | 312/220 |
| 2011/0062838 | A1 | 3/2011 | Kim et al. | |

FOREIGN PATENT DOCUMENTS

| | | | |
|---|---|---|---|
| KR | 1020070038720 A | * | 4/2007 |
| KR | 10-2009-0079794 | | 7/2009 |
| KR | 1020090079793 A | * | 7/2009 |

OTHER PUBLICATIONS

Non-Final Office Action mailed Jan. 6, 2014 in U.S. Appl. No. 12/879,599.

* cited by examiner

*Primary Examiner* — Jason Ko

(74) *Attorney, Agent, or Firm* — Banner & Witcoff, Ltd.

(57) ABSTRACT

A latch plate and striker assembly serve also to prop open the door of a front load laundry washer or other washing or laundry appliance, so as to releasably maintain the door in an open, chamber venting position (regardless of whether the appliance installation is perfectly level). The latch plate also includes a ramped receptacle, and the strike structure includes a prong designed to be guided into the receptacle by the ramp, to align (as necessary) the door strike with the door latch/lock as the door is closed.

10 Claims, 10 Drawing Sheets

APPLIANCE DOOR PROP MECHANISM

BACKGROUND OF THE INVENTION

The present invention relates to appliance door constructions, and particularly to doors operable to removably close an access opening of a washing and/or laundry appliance, e.g., the rotatable drum/wash basin of an automated laundry washing machine.

Automated washing machines (e.g., laundry washing machines and dish washers) typically include a door that swings open and shut to permit access to the wash chamber, basin or drum, for placement of wash load items in the chamber at the initiation of the wash process and removal of the wash load items upon completion of a wash operation. Automated laundry dryers typically have a similar arrangement of a moveable door and access opening. In both laundry washers and dryers, various types of latch assemblies are utilized to securely hold the door shut. Especially in the case of front load laundry washers and dryers, such door latch systems typically include an elongate "strike" that protrudes from one of the door and the door receiving frame defining the access opening. The strike is configured to be engagingly received in a latch incorporated into the other one of the door and door receiving frame when the door is shut.

A problem that arises with such washing and drying appliances is the growth of mold and mildew within the treatment chamber, and associated surfaces and components, due to the repeated exposure to water and other wash liquids associated with the treatment operation of the appliance. A factor contributing to this problem is the lack of effective air venting within the chamber when the access door is closed. Left unaddressed, this can result in unsanitary conditions and an unpleasant smell.

To deal with this issue, laundry washing machines have been equipped to periodically run, or prompt a user to run, a clean cycle for cleaning the parts of the appliance exposed to wash water, e.g., through circulation of a chlorine bleach solution. It is also common practice with many homeowners and other users of laundry washing machines to leave the access door of the laundry appliance open between uses to vent the wash chamber. However, front load laundry washing machines, in particular, may be equipped with a door that swings open but has no mechanism for positively maintaining the door in an open position. The door may swing about a nominally vertically arranged hinge axis. In the event that the appliance is installed on an uneven surface, the door may tend to swing to a closed position under force of gravity. Even in a level installation, a slight inadvertent inward push on the door may cause it to close. Thus, the access door of many front load laundry washing machine is not reliably retained in an open position to allow for adequate venting of the inner wash chamber.

Accordingly, there exists a need for a mechanism, suitable for use in laundry and/or washing appliances, for positively maintaining an access door thereof in an open position, to thereby provide reliable chamber venting. In particular, an inexpensive and effective mechanism easily retrofitted to existing laundry and/or washing appliances would be highly desirable. A device that is easily and intuitively operable by a user, is breakage resistant and is non-interfering with normal appliance door operation, would be especially desirable.

Various devices are known for maintaining particular types of closures, e.g., building and vehicle doors/windows in an open/ajar position. Some examples are cited below. None of these is suited for use in a laundry or washing appliance application.

Swink U.S. Pat. No. 7,226,094 discloses a door latch extension attachable to a door jam for maintaining a door in an ajar position. The disclosed device is specially configured and intended for use with an entryway door with a knob, e.g., of a building structure (not an appliance).

Carter U.S. Pat. No. 7,172,224 discloses a quick-release latch extender that engages with a hasp of a swing-shut automobile window, to maintain the window in a partially opened condition.

Levenson U.S. Pat. No. 5,771,720 discloses a "Z-bar" door latch that can alternatively lock the door in deadbolt fashion, allow the door to open a limited distance, or allow the door to open freely.

A second, related problem that arises with laundry and/or washing appliance access doors is dimensional variances leading to misalignment of the mating components of a door latch assembly, e.g, a mating latch mechanism and door strike, which can potentially cause damage to the latch assembly over time. Therefore, a latch assembly that compensated for such misalignments upon closure of an appliance access door would be beneficial, and even more so if integrated with a mechanism, suitable for use in laundry and/or washing appliances, for positively maintaining an access door thereof in an open position, to thereby provide reliable chamber venting.

SUMMARY OF SELECTED INVENTIVE ASPECTS

The following summary generally addresses many of the features described herein, but is not intended to limit the scope of this disclosure or identify features of greater importance to the claims herein. Although an access door prop mechanism for use in a laundry washing appliance is described herein, it should be noted that the various features of the mechanism described are equally applicable to numerous other treatment systems in which it is desirable to provide for venting of an inner treatment chamber.

In one aspect, the invention provides an appliance, including a housing cabinet and an interior compartment defined within the housing cabinet. The housing cabinet defines an access opening to provide user access to the interior compartment, and has a door mounted to the cabinet so as to be moveable between an open position allowing the user access and a closed position extending over the access opening. A latch mechanism is mounted to one of the housing cabinet and door. A strike member is mountable to the other one of the cabinet and door so as to be engageable with the latch mechanism when the door is in the closed position, and thereby releasably retain the door in the closed position. An arm is mounted to the one of the housing cabinet and door to which the latch mechanism is mounted, the arm movable between a retracted position permitting unobstructed door closure and latch engagement, and an extended position serving to releasably retain the door in an at least partially open condition.

In another aspect, the arm is pivotably coupled to the one of the housing cabinet and door to which the latch mechanism is mounted, so as to swing between retracted and extended positions. The arm has a free end configured to snap-clip onto the strike member such that when the arm is in an extended position, the arm is releasably engageable with the strike member so as to releasably fix the door in a partially opened position. Upon release from the strike member, the arm is pivotably coupled so as to swing downwardly into the retracted position under force of gravity. The pivotable coupling of the arm further permits the arm to swing upwardly to a second retracted position in response to door closure forces imparted to the arm, the second retracted position permitting unobstructed door closure and latch engagement.

In another aspect, the invention provides a latch plate assembly for installation with a latch mechanism in an appliance comprising a housing cabinet and an access opening, so as to receive and releasably engage a strike member to releasably retain a door of the appliance in a closed position closing the access opening. The latch plate assembly comprises a base plate attachable to the housing cabinet in overlying relation to the latch mechanism, the base plate having an aperture for passage of the strike member therethrough. The assembly further comprises an arm pivotably mounted to the base plate so as to swing between a retracted position lying generally flat against the base plate, and an extended position extending away from the base plate. In the retracted position, the arm leaves the aperture of the base plate substantially unobstructed.

The snap-clip structure of the arm is provided proximal a free end of the arm. The snap-clip structure comprises an elongate guideway provided with a tapered surface for making camming engagement with a corresponding surface of the strike member. The elongate guideway extends at an acute angle in relation to a central longitudinal axis of the arm.

According to another aspect of the disclosure, a base plate is attachable to the housing cabinet in overlying relation to the latch mechanism and has an aperture for the strike member to pass through upon closure of the access door. The aperture of the base plate has a ramped entry way for guiding the strike member into the aperture in a manner so as to correct a misalignment between the strike member and aperture during closure of the access door.

The above and other objects, features and advantages of the present invention will be readily apparent and fully understood from the following detailed description of preferred embodiments, taken in connection with the appended drawings.

DETAILED DESCRIPTION OF EXEMPLARY EMBODIMENTS

Figure 1:
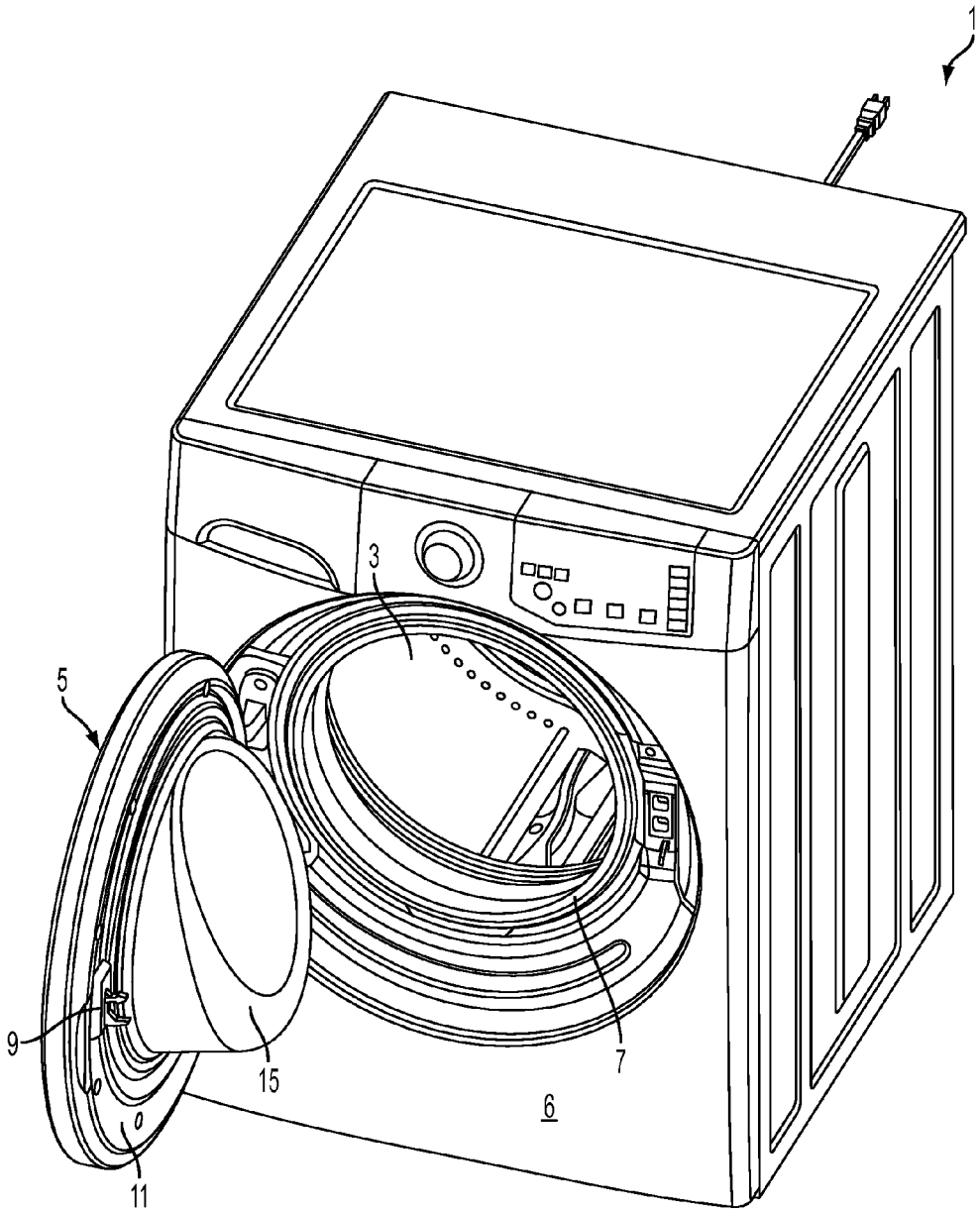
FIG. 1 is a front perspective view of a front load automatic laundry washer, with an access door thereof open to reveal a strike and latch set to which aspects of the invention are applied.
Figure 2:
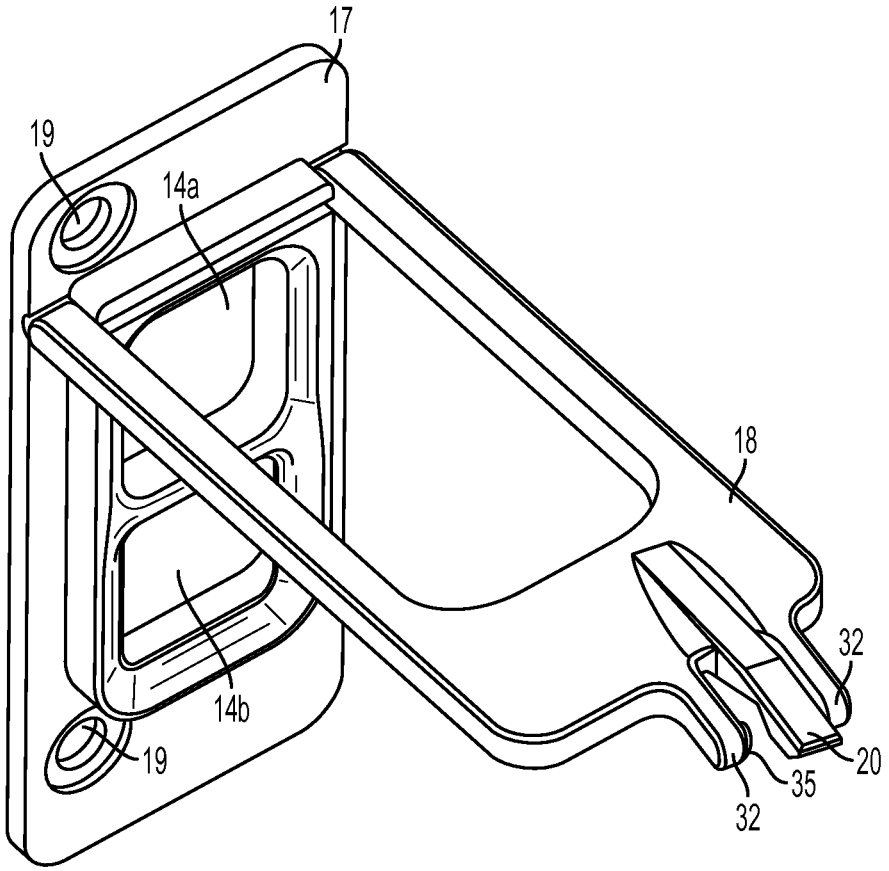
FIG. 2 is a perspective view of an inventive latch plate assembly (as seen in FIG. 1), the latch plate assembly including a base plate and a moveable arm in an extended position.

Referring first to FIG. 1, illustrated is an exemplary laundry washing appliance (machine) 1 of the front-load, rotating drum variety. The washing machine 1 includes a port-hole style access opening 3, and an access door 5 hingedly mounted on a cabinet front panel or bulkhead 6 to swing between open and closed positions.

Surrounding access opening 3 is a compressible door bellow 7 of rubber or the like that provides a water-tight flexible connecting passage extending between the access opening of the suspended wash group and the access opening 3 of the cabinet front panel 6. Bellow 7 also serves to provide a liquid-tight seal with access door 5 when the door is closed and latched. With access door 5 in the open position as shown in FIG. 1, it can be seen that a door strike structure 9 is mounted on and protruding inwardly from an inner frame 11 of the door 5. In one embodiment, the inner frame 11 has a construction as described in commonly owned copending application Ser. No. 11/944,032, filed Nov. 21, 2007, published as No. 2009/0126417 A1. In the case of a washer (as illustrated), this inner frame 11 surrounds an inwardly directed port-hole plug structure 15, which may be formed of molded transparent plastic, glass or other like materials or combinations thereof. Plug structure 15 serves to protect bellow 7 from tumbling load items and to redirect clothes back toward the cavity of the drum as they are tumbled during washing operation.

A strike member 9*a* of strike structure 9 interacts with a latch mechanism in order to securely hold access door 5 in its closed position. The latch mechanism is, in this embodiment, installed within the frame or housing structure on the backside of front cabinet panel 6 surrounding circular access opening 3. The latch mechanism may be of a conventional construction and may include a safety interlock for preventing access door 5 from being opened during certain operation cycles, such as high-speed washer spin cycles. In one embodiment, the latch mechanism is a push-push style latch that both opens (unlatches) and closes (latches) with the press of access door 5. Such latches, which are of well know construction, require inward displacement of the strike relative to the latch structure in order to actuate both latching and unlatching. Rather than making the strike part of a push-button mechanism moveable independently of the door, in the embodiment illustrated in FIG. 1, strike plate structure 9 is generally fixedly mounted to extend inwardly from the inside surface of door frame 11. As such, in effect, the entire access door 5 acts as a very large push-button. A closure of access door 5 (a first push) effects a latching of the door, i.e., strike member 9*a* is trapped within the latch. A second inward push on the closed access door 5 effects an unlatching operation.

Figure 3:
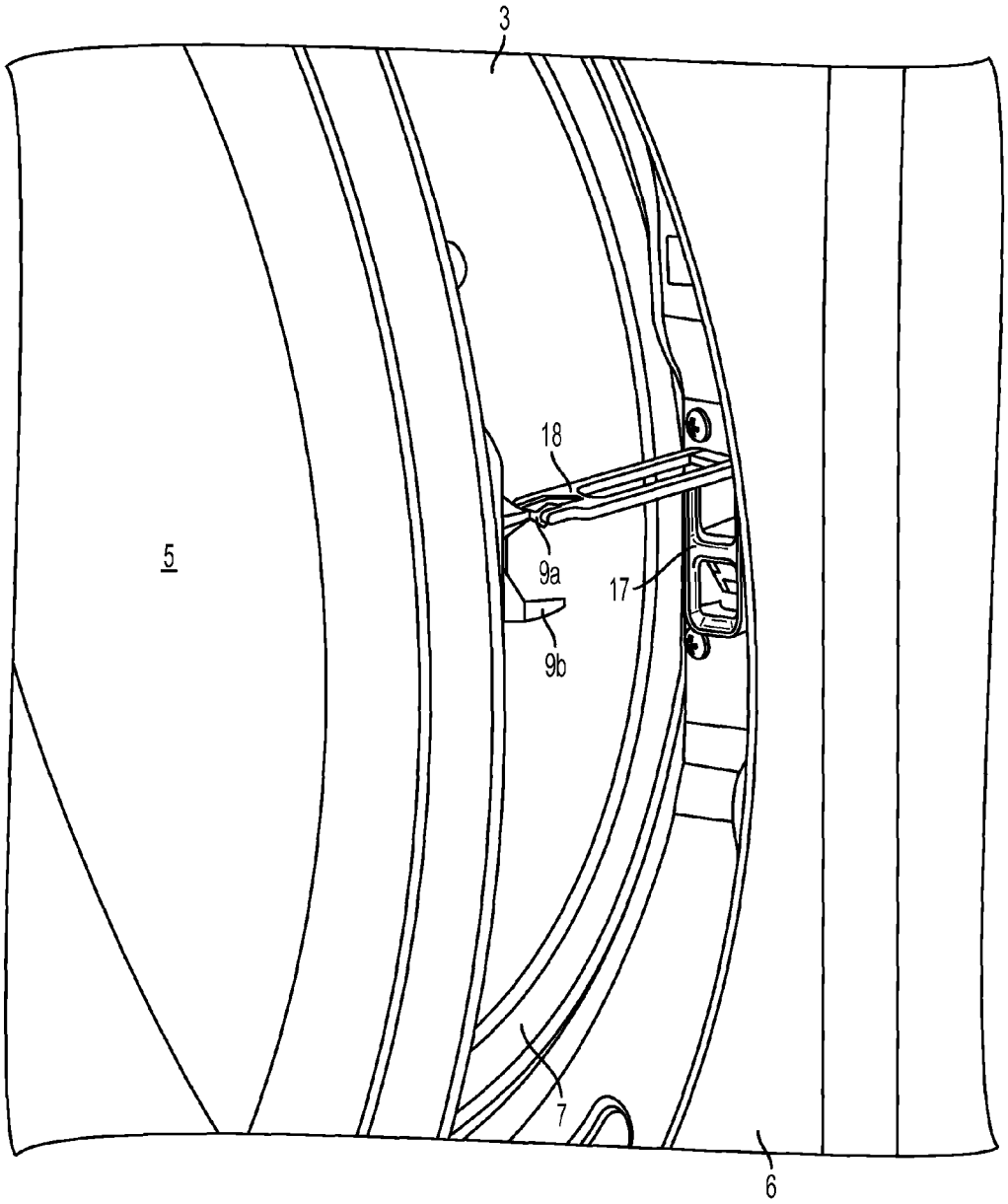
FIG. 3 is a front perspective view of the latch plate assembly shown in FIG. 2 mounted on the front panel of the washer and the moveable arm engaged with a strike member of the access door strike structure shown in FIG. 1, to maintain the access door in a partially opened position in accordance with the illustrative embodiment of the invention.
Figure 4:
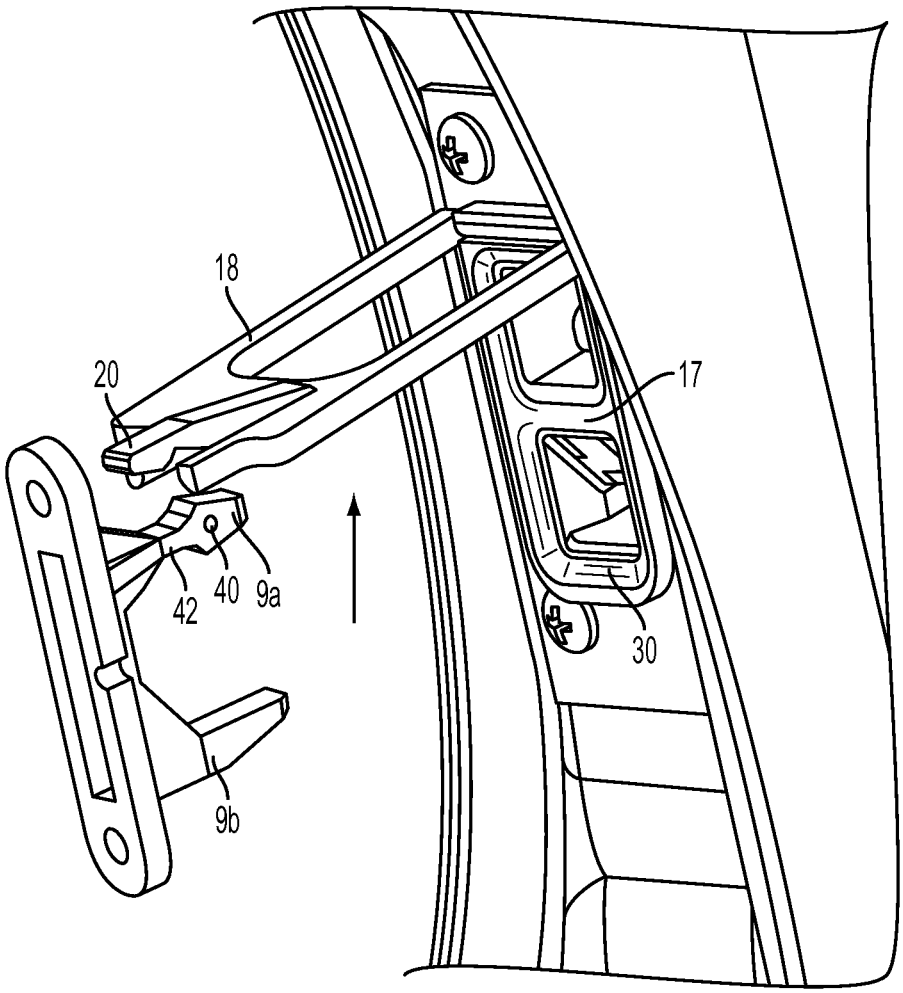
FIG. 4 is a perspective view of the strike structure and latch plate assembly shown in FIG. 3, with the access door omitted to show a first position and upward directional movement of the moveable arm prior to engagement with the strike member, in accordance with an aspect of the invention.
Figure 5:
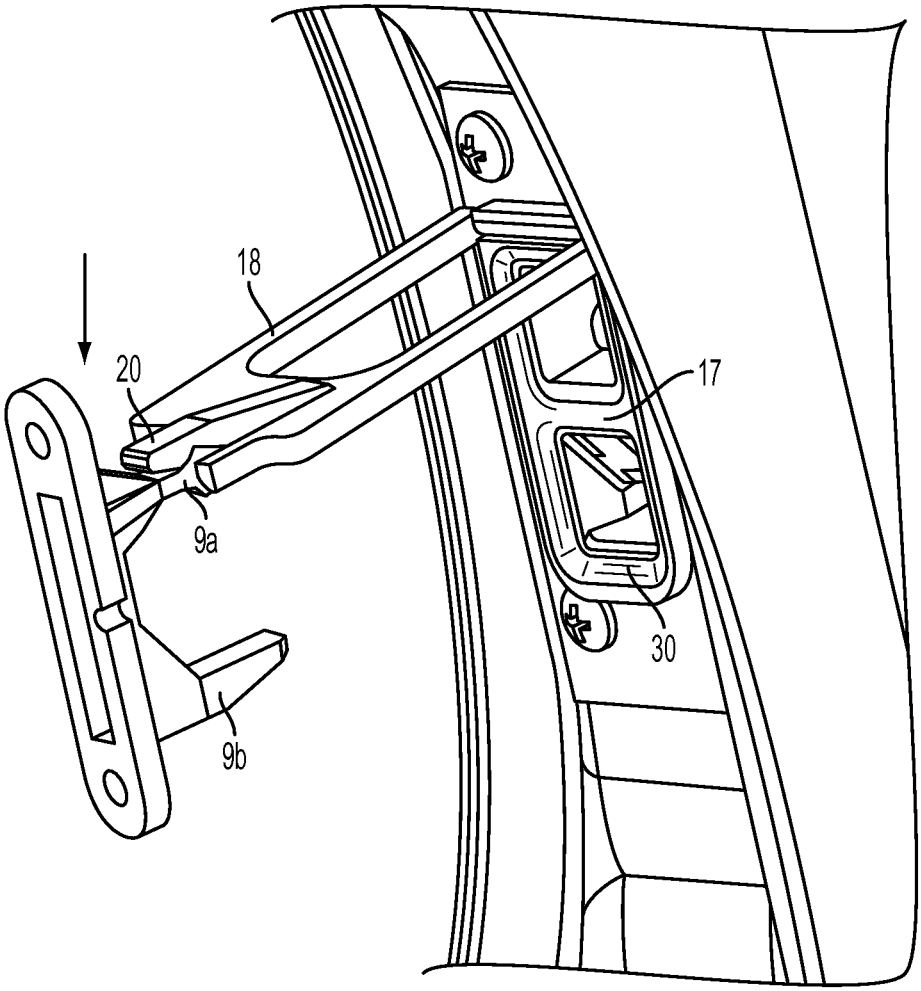
FIG. 5 is a perspective view of the strike structure and latch plate assembly shown in FIG. 4, the moveable arm in a second position and engaged with the strike member, with the directional movement of the arm to reach the second position indicated, in accordance with an aspect of the invention.

Referring to FIGS. 2-6, illustrated more clearly are various aspects of the access door prop feature of the disclosure. A washer door latch plate assembly includes a base plate 17 that may be attached to the front cabinet panel 6 in overlying relation to the latch mechanism (not visible), such as by screws passing through mounting holes 19 (see FIGS. 7 and 8). Base plate 17 of the latch plate assembly includes upper and lower apertures 14*a* and 14*b* (visible in FIG. 2), respectively, for passage of strike member 9*a* and a strike guide member 9*b* of strike structure 9 when access door 5 is moved to its closed position. A swing-out arm 18 is connected to the base plate. Arm 18, when swung out to extend generally perpendicularly to the base plate 17 and toward an open access door of the associated appliance (e.g., access door 5 of washer machine 1 as shown in FIG. 1), can be clipped on to strike member 9*a*. In this manner, the access door can be reliably propped open to a drum venting position, regardless of whether the appliance installation is perfectly level. In FIGS. 4-5, the open access door, the inner frame 11 on which strike 9 is fixedly mounted, has been removed for the purpose of showing details related to the engagement and disengagement of arm 18 and strike member 9*a*. In one embodiment, base plate 17 and arm 18 are each of a unitary molded plastic construction.

As shown in FIG. 3, arm 18 is in an extended position extending generally perpendicular to base plate 17, and is engaged with strike member 9*a* to prop access door 5 in a partially opened position. Upon a pull of access door 5 to a more open position than that illustrated in FIG. 3, arm 18 is operable to readily release from strike member 9*a*, and to fall to a flush (folded-in) storage position, such as that illustrated in FIG. 6, to allow access door 5 to be freely shut. If the door is forcibly pushed to shut while arm 18 is engaged with strike member 9*a*, the clip retention of arm 18 on strike member 9*a* will release, arm 18 will ride up over the head of strike member 9*a* and fold upwardly to a second folded position (not shown) that also allows the door to fully shut without damage. If damage to arm 18 does occur, this inexpensive part can be readily replaced by virtue of its snap-in pivot mount, which is described in greater detail below with reference to FIG. 8. In addition, associated with the door prop feature of the present disclosure is a ramped entry way 30 of the lower aperture 14*b* of base plate 17, for correcting misalignments of strike member 9*a* with the latch provided in registry behind upper aperture 14*a*, when access door 5 is closed. Various structural and interactive aspects of ramped entry way 30 and guide member 9*b* are described in further detail below.

Figure 6:
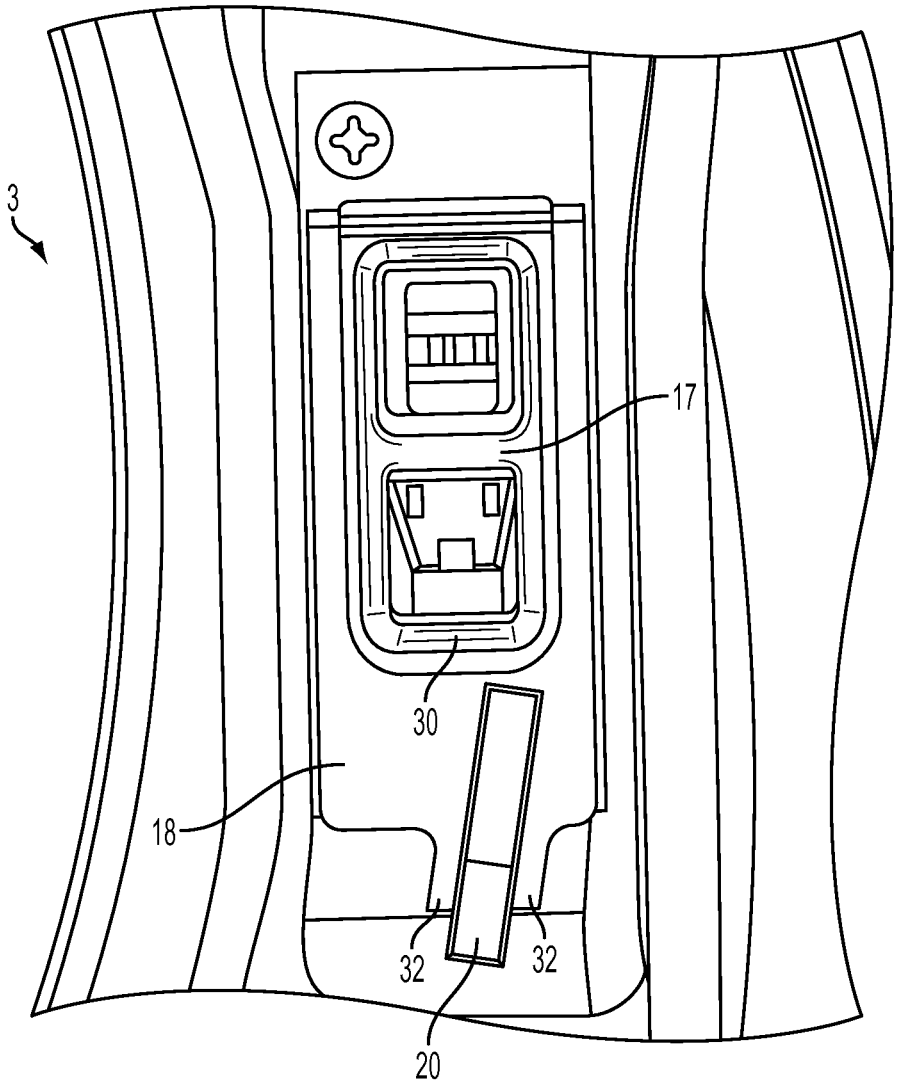
FIG. 6 is a front elevation view of the latch plate assembly shown in FIG. 2, installed on a portion of the washer front panel as shown in FIG. 3, with the arm of the latch plate assembly folded downwardly to a flush, storage (non-use) position.

As shown in FIG. 6, the illustrative access door prop feature described above includes arm 18, which may be of a generally "wishbone" shape, pivotally mounted, such as by an integrally formed axle 22, to base plate 17 installed within a front panel of the washer. Arm 18 is pivotably mounted so as to be freely swingable between a first retracted storage position in which arm 18 is folded down generally flush against the base plate 17, leaving unobstructed apertures 14*a* and 14*b*, and a second retracted storage position, angularly separated from the first retracted position by approximately 180°, in which arm 18 also lies generally flush against an upper portion of base plate 17 and overlapping on to the adjacent washer front panel surface. For use, arm 18 swings out to a generally horizontal, extended position where its specially-configured free end can engage strike member 9*a* and thereby positively, yet releasably, hold the door in an open position to allow for venting of the interior housing compartment of the washer. As described in further detail below, a snap-clip structure of the free end of arm 18 includes an elongate guideway clip mechanism extending at an acute angle in relation to a central longitudinal axis of arm 18. The guideway structure, which is also offset slightly from the arm's longitudinal axis, comprises side prongs 32 and a top clip member 20.

Referring now to FIGS. 4-5, in addition to showing the various features described above, illustrated are exemplary stages of engagement of arm 18 and strike member 9*a* in accordance with aspects of the inventive access door prop feature. As indicated in FIG. 4 by the upwardly pointing arrow, for use, arm 18 swings upwardly from its non-use position (e.g., the folded-down position of arm 18 illustrated in FIG. 6) to an extended position that is above the horizontal position of strike member 9*a*. Once arm 18 is so extended, access door 5 may be pushed in the closing direction until top clip member 20 is substantially directly above the head of strike member 9*a*, as shown in FIG. 4. Referring to FIG. 5, illustrated is arm 18 engaged with strike member 9*a* by a snap-clip engagement of the snap-clip structure of the free end of arm 18 with the head of strike member 9*a*. This may be effected by a downward swing of arm 18, as indicated by the downward pointing arrow and/or by advancing the strike member 9*a* into the guideway clip mechanism from the front. As illustrated, the head of strike member 9*a* is engaged beneath top clip member 20. Top clip member 20 has a tapered bottom surface protrusion that is releasably retained in a cooperatively formed neck region 42 of strike member 9*a*, located behind the forwardly tapering flared head of the strike member (visible in FIG. 4). As shown, the head of strike member 9*a* may have a blunted arrowhead-like shape, which can facilitate entry into the guideway clip mechanism.

Figure 7:
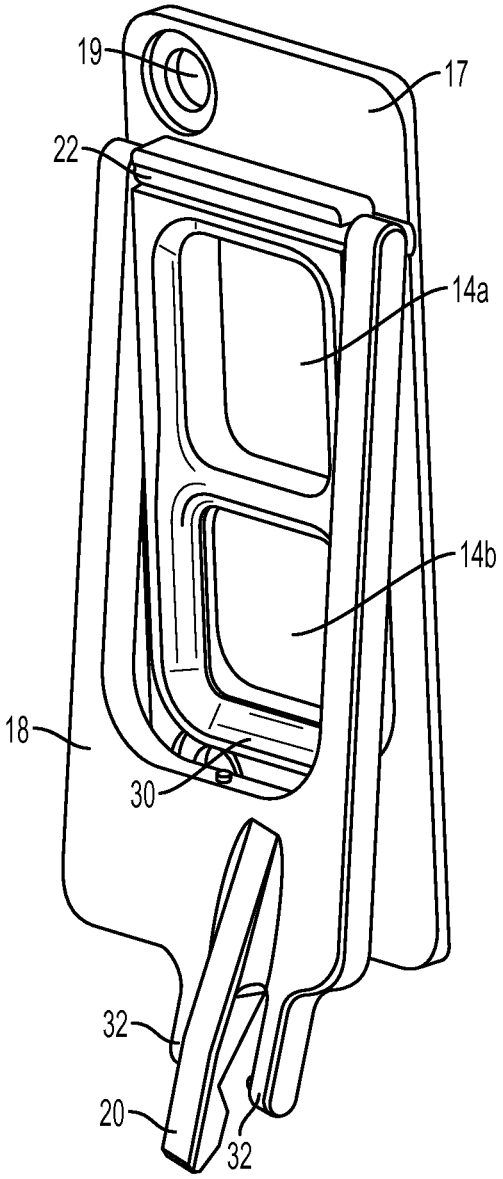
FIG. 7 is a perspective view of the latch plate assembly shown in FIG. 6, with the arm of the latch plate assembly slightly displaced from its flush, storage position.
Figure 8:
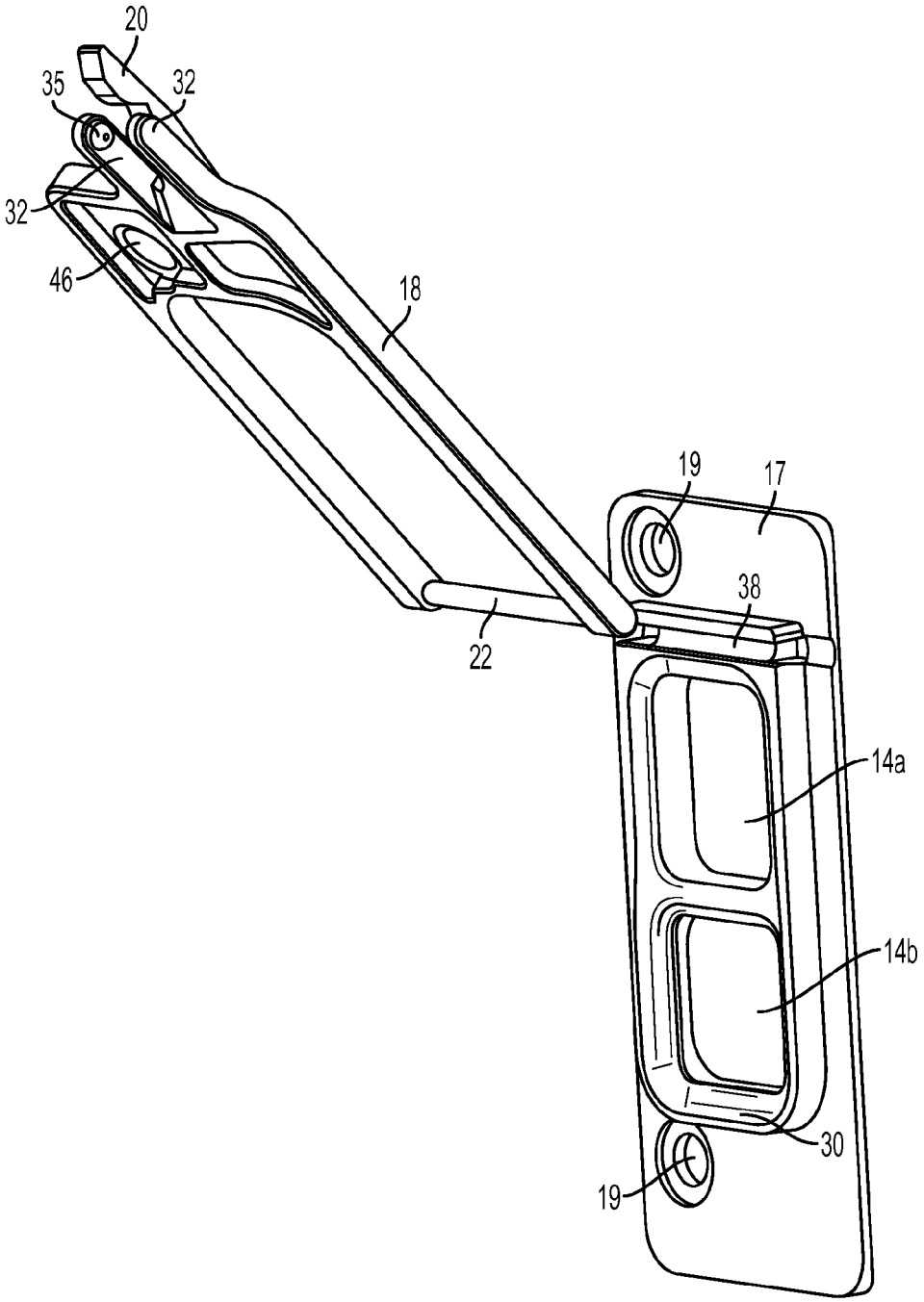
FIG. 8 is a perspective assembly view of the latch plate assembly shown in FIG. 7, the arm of the latch plate assembly including a pivot axle and the base plate of the latch plate assembly including a snap-in recess for pivotally mounting the arm via the axle.
Figure 9:
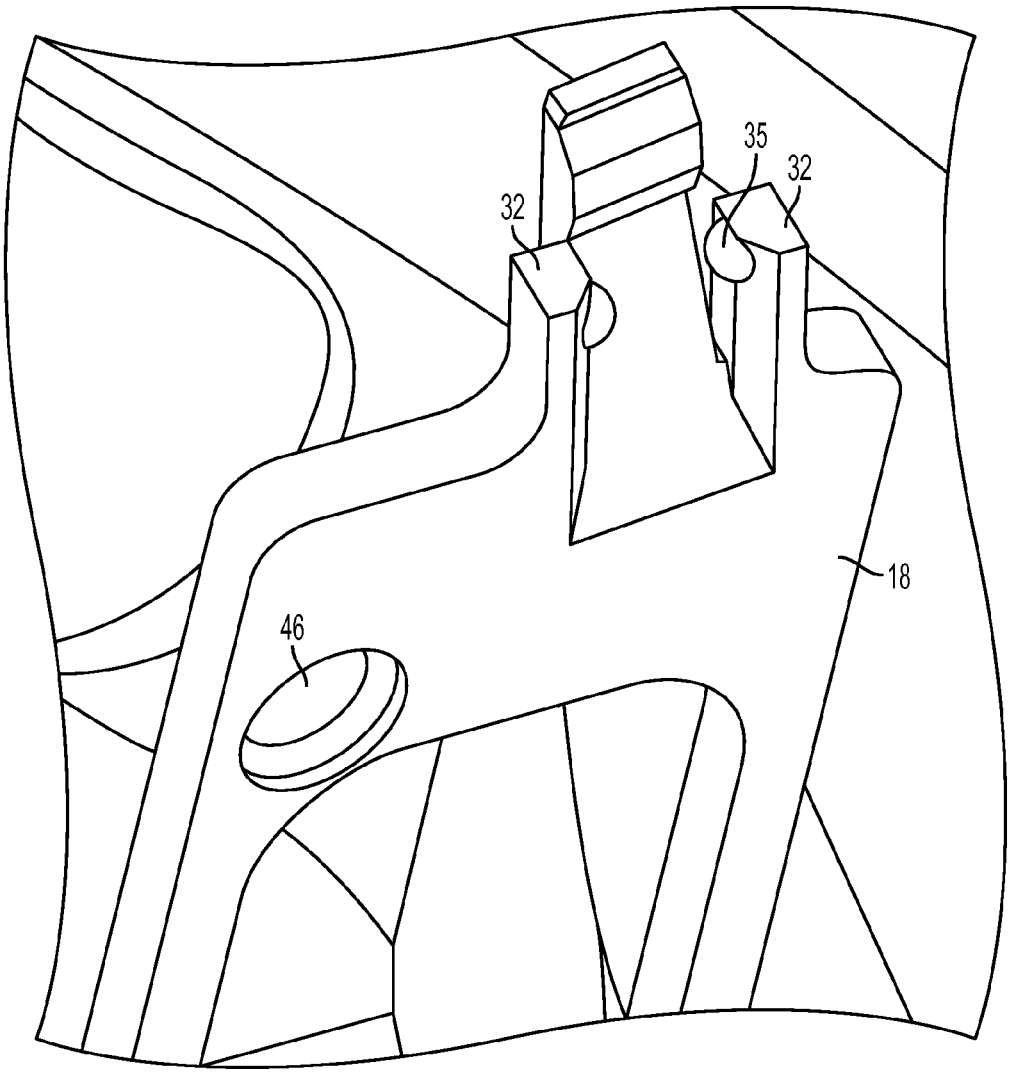
FIG. 9 is a bottom perspective view of a portion of the arm of the latch plate assembly shown in FIGS. 7-8, the portion of the arm showing the snap-clip detent structure of the arm with which a head of the strike member releasably engages.
Figure 10:
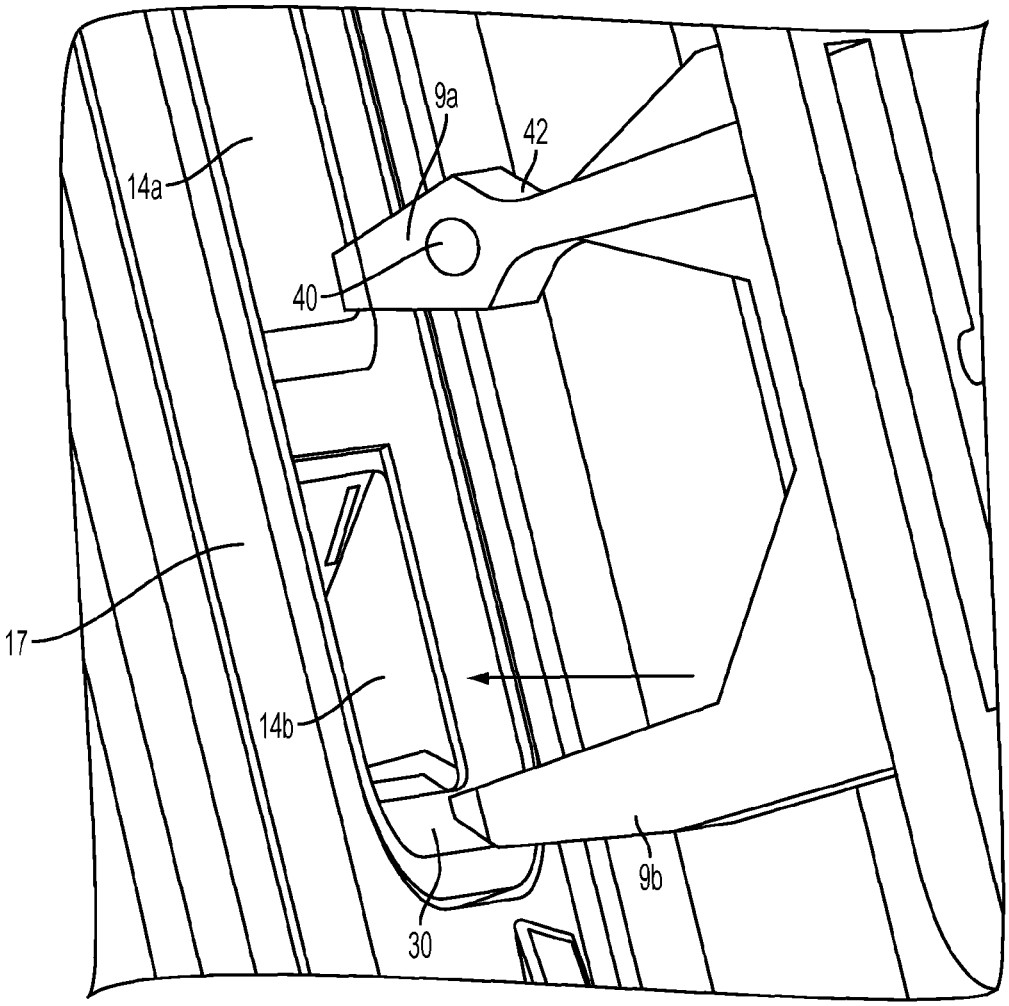
FIG. 10 is a perspective view of a portion of the door strike structure and latch plate assembly shown previously, with the moveable arm of the latch plate assembly in its folded flat storage position, and the strike member and a strike guide member of the door strike structure entering receptacles of the latch plate in accordance with an aspect of the disclosure.

Referring to FIGS. 7-9, illustrated are further structural details of the various components comprising the latch plate assembly described above. As shown in FIGS. 7-9, the snap-clip structure of the free end of arm 18 includes a guideway clip structure comprising side prongs 32 and top clip member 20, which together form a detent mechanism in which strike member 9*a* enters for engagement. Each of side prongs 32 is elastically flexible and has formed on its inward facing surface a spherical protrusion 35 that snaps into a corresponding recess (e.g., recesses 40 as illustrated in FIGS. 4 and 10) formed on opposite sides of the head of strike member 9*a*, when arm 18 engages with strike member 9*a*. Top clip member 20, by virtue of its flexibility, snap-clips into releasable retaining engagement with neck region 42 formed behind the head of strike member 9*a*.

As shown in FIG. 8, the surface of arm 18 that comes into contact with base plate 17 when arm 18 is in its retracted position includes a screw hole 46 in alignment with lower hole 19 of base plate 17, to allow arm 18 to fold down to a position flush with the front panel of the washer without interference. Also, as illustrated most clearly in FIG. 8, hinge axle 22 allows for arm 18 to rotate between its closed and extended positions. Hinge axle 22 may be snap-clipped into a resilient seat structure 38 formed on base plate 17, to allow for arm 18 to be readily removed and replaced in the event that damage to arm 18 occurs.

While arm 18 is effective to hold access door 5 in a partially open position, such as that shown in FIG. 3, the free end of arm 18 is configured to disengage with strike member 9*a* in the event that access door 5 is either pulled to a further open position, or pushed in the closing direction. With an opening pull on access door 5, arm 18 releases from engagement with strike member 9*a* and may fall under gravity to a folded position flush with cabinet front panel 6 where arm 18 poses no obstacle to access door 5 closing. If, while in an open drum venting position, access door 5 is instead pushed in the closing direction, arm 18 is configured to ride up and over the head of strike member 9*a*, and fold upwards to an alternate raised position permitting access door 5 to properly close without breakage or damage to arm 18. Such action is facilitated by the guideway clip structure of the arm, and particularly the cooperating tapered surfaces of top clip member 20 and the head of strike member 9*a*.

As described above with reference to FIGS. 4-5, the configuration illustrated allows arm 18 to release from strike member 9*a* upon either a push or pull of access door 5, and either fold up or collapse down to a position that allows access door 5 to close without damage to the strike structure, latch plate assembly or any other component of the washer, and without requiring a separate manual disengagement of arm 18 from strike member 9*a*.

Another aspect of the present disclosure relates to guide member 9*b* provided as part of strike structure 9, and a corresponding reception structure of latch base plate 17. Referring to FIG. 10, prong-like guide member 9*b* extends in generally parallel spaced relationship to strike member 9*a*. As shown, guide member 9*b* is entering ramped entryway 30 of lower aperture 14*b* of base plate 17. A tapered lower surface of the leading end of guide member 9*b* provides a camming engagement with ramped entryway 30 in the event of a downward misalignment of strike member 9*a* with the latch. As indicated by the arrow 45 shown in FIG. 10, as guide member 9*b* enters lower aperture 14*b* with vertical misalignment, guide member 9*b* rides upwards on ramped entryway 30, thereby also guiding strike member 9*a*, which extends in parallel to guide member 9*b*, through the upper aperture 14*a* and into proper engagement with the underlying latch. In one embodiment, as guide member 9*b* enters lower aperture 14*b* with vertical misalignment, guide member 9*b* rides upwards on ramped entryway 30 having a vertical rise of approximately 5 mm.

The present invention has been described in terms of preferred and exemplary embodiments thereof. Numerous other embodiments, modifications and variations within the scope and spirit of the appended claims will occur to persons of ordinary skill in the art from a review of this disclosure.

The invention claimed is:

1. A drum type washing machine comprising:

a body having a front surface thereof with an entrance opening for entrance/exit of laundry;

a drum rotatably mounted within said body for receiving said laundry;

a front door rotatably coupled at one end thereof to the front surface of the body and serving to open or close the entrance opening; and a supporting unit installed to one of the front door and the body and being movable thereon between a retracted position and an extended position, and adapted to come into contact with the other of the front door and the body when in said extended position, thereby serving to limit rotation of the door toward said body and thus maintain the entrance opening at least partially open, said supporting unit, when in said retracted position, allowing the front door to fully close, said supporting unit remaining on said one of the front door and the body in both said retracted position and said extended position, and during movement therebetween, said supporting unit further being configured to rest in said extended position and being inoperable for opening the door from a closed, latched position.

2. The drum type washing machine of claim 1, wherein the supporting unit is movable from said extended position to a said retracted position when an external force is applied to the front door and said other of the front door and the body is in contact with the supporting unit.

3. A drum type washing machine comprising:

a body having a front surface thereof with an entrance opening for entrance/exit of laundry;

a drum rotatably mounted within said body for receiving said laundry;

a front door rotatably coupled at one end thereof to the front surface of the body and serving to open or close the entrance opening;

and a supporting unit installed to the body and being movable thereon between a retracted position and an extended position, and adapted to come into contact with the front door when in said extended position, thereby serving to limit rotation of the door toward said body and thus maintain the entrance opening at least partially open, said supporting unit, when in said retracted position, allowing the front door to fully close, said supporting unit remaining on said body in both said retracted position and said extended position, and during movement therebetween, said supporting unit further being configured to rest in said extended position and being inoperable for opening the door from a closed, latched position.

4. The drum type washing machine of claim 3, wherein the supporting unit includes a supporting body arranged to couple the body to the front door, the supporting body being movable between the body and the front door.

5. The drum type washing machine of claim 3, wherein the supporting unit is movable from said extended position to a said retracted position when an external force is applied to the front door and the front door is in contact with the supporting unit.

6. A drum type washing machine comprising:

a body having a front surface thereof with an entrance opening for entrance/exit of laundry;

a drum rotatably mounted within said body for receiving said laundry;

a front door rotatably coupled at one end thereof to the front surface of the body and serving to open or close the entrance opening; and a supporting unit rotatably installed to one of the front door and the body and being movable thereon between a retracted position and an extended position, and adapted to come into contact with the other of the front door and body when in said extended position, thereby serving to limit rotation of the door toward said body and thus maintain the entrance opening at least partially open, said supporting unit, when in said retracted position, allowing the front door to fully close, said supporting unit remaining on said one of the front door and the body in both said retracted position and said extended position, and during movement therebetween, said supporting unit further being configured to rest in said extended position and being inoperable for opening the door from a closed, latched position.

7. The drum type washing machine of claim 6, wherein the supporting unit is movable from said extended position to a said retracted position when an external force is applied to the front door and said other of the front door and the body is in contact with the supporting unit.

8. A drum type washing machine comprising:

a body having a front surface thereof with an entrance opening for entrance/exit of laundry;

a drum rotatably mounted within said body for receiving said laundry;

a front door rotatably coupled at one end thereof to the front surface of the body and serving to open or close the entrance opening; and a supporting unit rotatably installed to the body and being movable thereon between a retracted position and an extended position, and adapted to come into contact with the front door when in said extended position, thereby serving to limit rotation of the door toward said body and thus maintain the entrance opening at least partially open, said supporting unit, when in said retracted position, allowing the front door to fully close, said supporting unit remaining on said body in both said retracted position and said extended position, and during movement therebetween, said supporting unit further being configured to rest in said extended position and being inoperable for opening the door from a closed, latched position.

9. The drum type washing machine of claim 8, wherein the supporting unit rotates into contact with the body when an external force is applied to the front door and the front door is in contact with the supporting unit.

10. The drum type washing machine of claim 8, wherein the supporting unit is movable from said extended position to a said retracted position when an external force is applied to the front door and the front door is in contact with the supporting unit.

* * * * *